US006010018A

United States Patent [19]

Pech

[11] Patent Number: 6,010,018

[45] Date of Patent: Jan. 4, 2000

[54] SWING LOCK MECHANISM

[75] Inventor: David J. Pech, Manitowoc, Wis.

[73] Assignee: Manitowoc Crane Group, Inc., Reno, Nev.

[21] Appl. No.: 08/826,627

[22] Filed: Apr. 3, 1997

[51] Int. Cl.[7] ..... B66L 23/84

[52] U.S. Cl. ..... 212/292; 212/253; 212/247; 188/31; 192/69.62

[58] Field of Search ..... 212/180, 181, 212/247, 253, 292; 74/813 L, 411.5; 188/31; 192/69.62

[56] References Cited

U.S. PATENT DOCUMENTS

| | | | |
|---|---|---|---|
| 2,313,084 | 3/1943 | Manly | 212/68 |
| 2,562,086 | 7/1951 | Farrell | 212/253 |
| 2,672,203 | 3/1954 | Brown | 188/31 |
| 2,731,097 | 1/1956 | Zeilman et al. | 212/247 |
| 2,965,245 | 12/1960 | Zeilman et al. | 212/69 |
| 3,125,226 | 3/1964 | Mork et al. | 212/38 |
| 3,139,198 | 6/1964 | Penny et al. | 214/77 |
| 3,664,515 | 5/1972 | Orendorff et al. | 212/292 |
| 3,726,418 | 4/1973 | Short | 212/69 |
| 3,921,817 | 11/1975 | Petrik et al. | 212/66 |
| 3,923,407 | 12/1975 | Jensen et al. | 403/165 |
| 3,941,252 | 3/1976 | Six et al. | 212/69 |
| 3,972,378 | 8/1976 | Houriez et al. | 180/6.58 |
| 4,050,337 | 9/1977 | Allemand | 74/813 L |
| 4,231,699 | 11/1980 | Thompson | 414/687 |
| 4,248,488 | 2/1981 | Sable | 308/220 |
| 4,332,328 | 6/1982 | Otto et al. | 212/180 |
| 4,391,477 | 7/1983 | Morrow, Sr. | 308/221 |
| 4,436,444 | 3/1984 | Scherrer | 403/24 |
| 4,478,340 | 10/1984 | Delago | 212/253 |
| 4,588,057 | 5/1986 | Weich et al. | 74/411.5 |
| 4,622,860 | 11/1986 | Cametti et al. | 74/448 |
| 4,784,278 | 11/1988 | Luscombe | 212/229 |
| 5,176,267 | 1/1993 | Pech | 212/180 |
| 5,402,898 | 4/1995 | Lute | 212/255 |
| 5,542,812 | 8/1996 | Grove et al. | 414/543 |

FOREIGN PATENT DOCUMENTS

| | | | |
|---|---|---|---|
| 24 34 376 | 2/1975 | Germany | B66C 23/84 |
| 7804546 | 10/1978 | Netherlands | B66C 23/36 |
| 135909 | 5/1952 | Sweden | 212/247 |
| 670528 | 6/1979 | U.S.S.R. | B66C 23/94 |
| 965976 | 10/1982 | U.S.S.R. | B66C 23/84 |
| 630711 | 10/1949 | United Kingdom | 212/247 |
| 2 097 752 | 11/1982 | United Kingdom | B66C 23/86 |

OTHER PUBLICATIONS

Solving the Quick–Disconnect Problem for Big Bearings, Sable, H., Machine Design, Jul. 7, 1983.

American Crawler Cranes Series 1000 Brochure, American Hoist & Derrick Co.

Manitowoc 4100W Brochure, Manitowoc Engineering Co., 1972.

Manitowoc 3950D Dragline Brochure, Manitowoc Engineering Co., 1985.

*Primary Examiner*—Thomas J. Brahan

*Attorney, Agent, or Firm*—Brinks Hofer Gilson & Lione

[57] ABSTRACT

A swing lock mechanism for machines having an upper works rotatably mounted on a lower works by a swing bearing is connected to the drive shaft of a swing bearing drive assembly and comprises a swing lock plate, an annular pin support, and a plurality of locking pins. The swing lock plate is affixed to the drive shaft and has at least one hole disposed about the axis of the drive shaft. The annular pin support is fixed against rotation relative to the drive shaft is disposed about the axis of the drive shaft. The locking pins are supported by the annular pin support and are also disposed about the axis of the drive shaft. The locking pins are arranged in such a manner so as at least one pin may engage a hole in the swing lock plate irrespective of the angular orientation of the swing lock plate relative to the annular pin support.

39 Claims, 6 Drawing Sheets

SWING LOCK MECHANISM

BACKGROUND OF THE INVENTION

The present invention relates to machines, such as cranes, which have an upper works rotatably mounted on a lower works. In particular, the present invention provides a locking mechanism to prevent the upper works from rotating relative to the lower works.

Machines of this type utilize a swing bearing to permit rotation of the upper works relative to the lower works. It may be necessary, however, to prevent the rotation of the upper works during certain lifting operations. It may also be necessary to prevent the rotation of the upper works when the machine has been shut down. For example, a crane having a large boom has a tendency to swing with the wind when not in use, which may result in injury or damage to nearby structures.

Known machines of this type typically employ a locking device connected directly to the swing bearing. Such devices often require the upper works to be carefully aligned with the lower works before engaging the device. It is therefore desirable to provide a swing lock mechanism which can be easily engaged.

SUMMARY OF THE INVENTION

The present invention provides a swing lock mechanism for machines having an upper works rotatably mounted on a lower works by a swing bearing. The swing lock mechanism is used to prevent the upper works from rotating relative to the lower works and can be used even while the machine is not being operated.

The swing lock mechanism of the present invention is connected to the drive shaft of a swing bearing drive assembly and comprises a swing lock plate, an annular pin support, and a plurality of locking pins. The swing lock plate is affixed to the drive shaft and has at least one hole disposed about the axis of the drive shaft. The annular pin support is fixed against rotation relative to the drive shaft and is disposed about the axis of the drive shaft. The locking pins are supported by the annular pin support and are also disposed about the axis of the drive shaft. The locking pins are arranged in such a manner so that at least one pin may engage a hole in the swing lock plate irrespective of the angular orientation of the swing lock plate relative to the annular pin support.

The preferred embodiment of the invention includes features in addition to those listed above. Moreover, the advantages over the current art discussed above are directly applicable to the preferred embodiment, but are not exclusive. The other features and advantages of the present invention will be further understood and appreciated when considered in relation to the detailed description of the preferred embodiment.

DETAILED DESCRIPTION OF THE DRAWINGS AND A PREFERRED EMBODIMENT OF THE INVENTION

Figure 1:
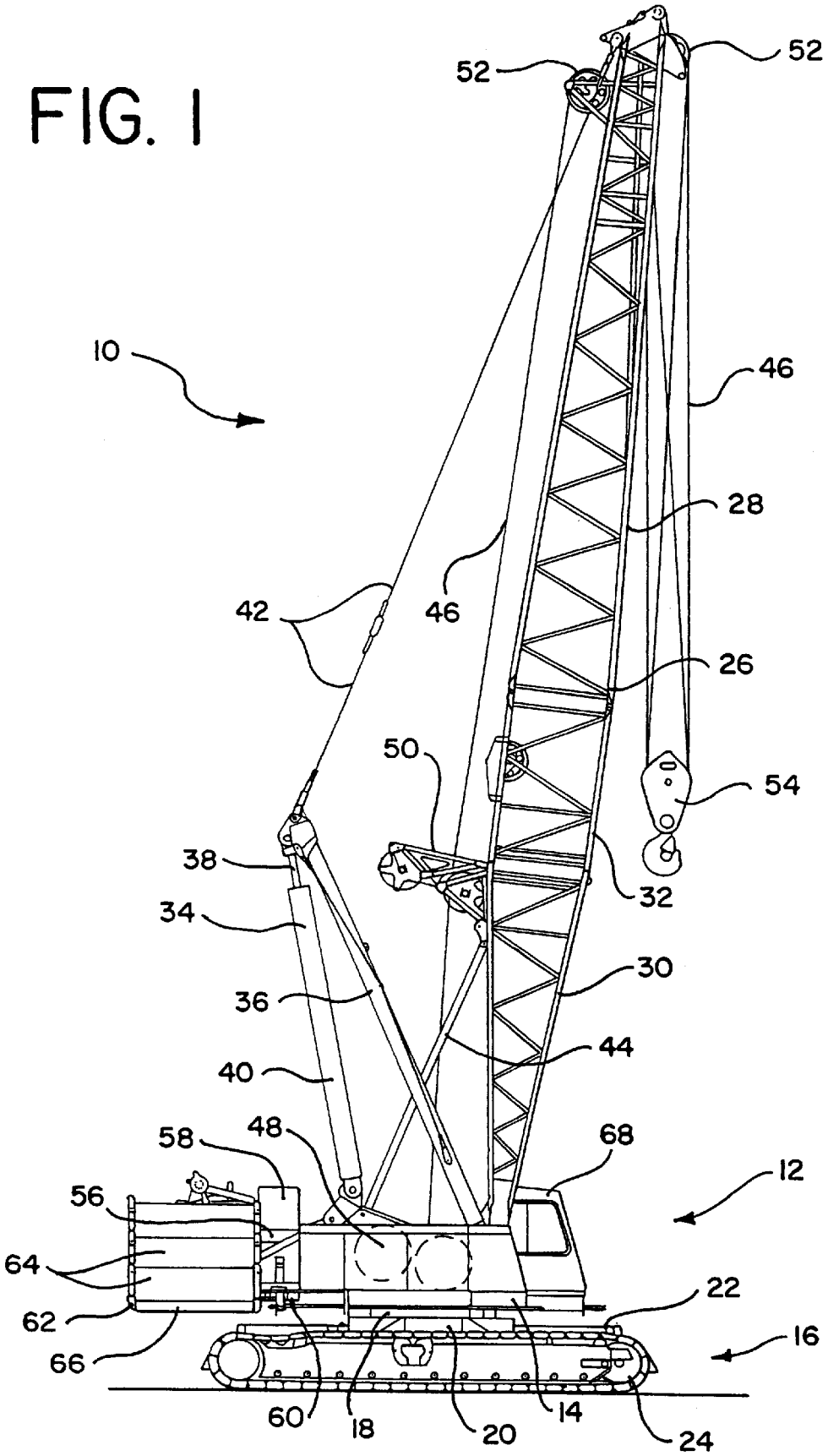
FIG. 1 is a right side elevational view of a complete crawler crane incorporating a swing lock mechanism made in accordance with the teachings of this invention.
Figure 2:
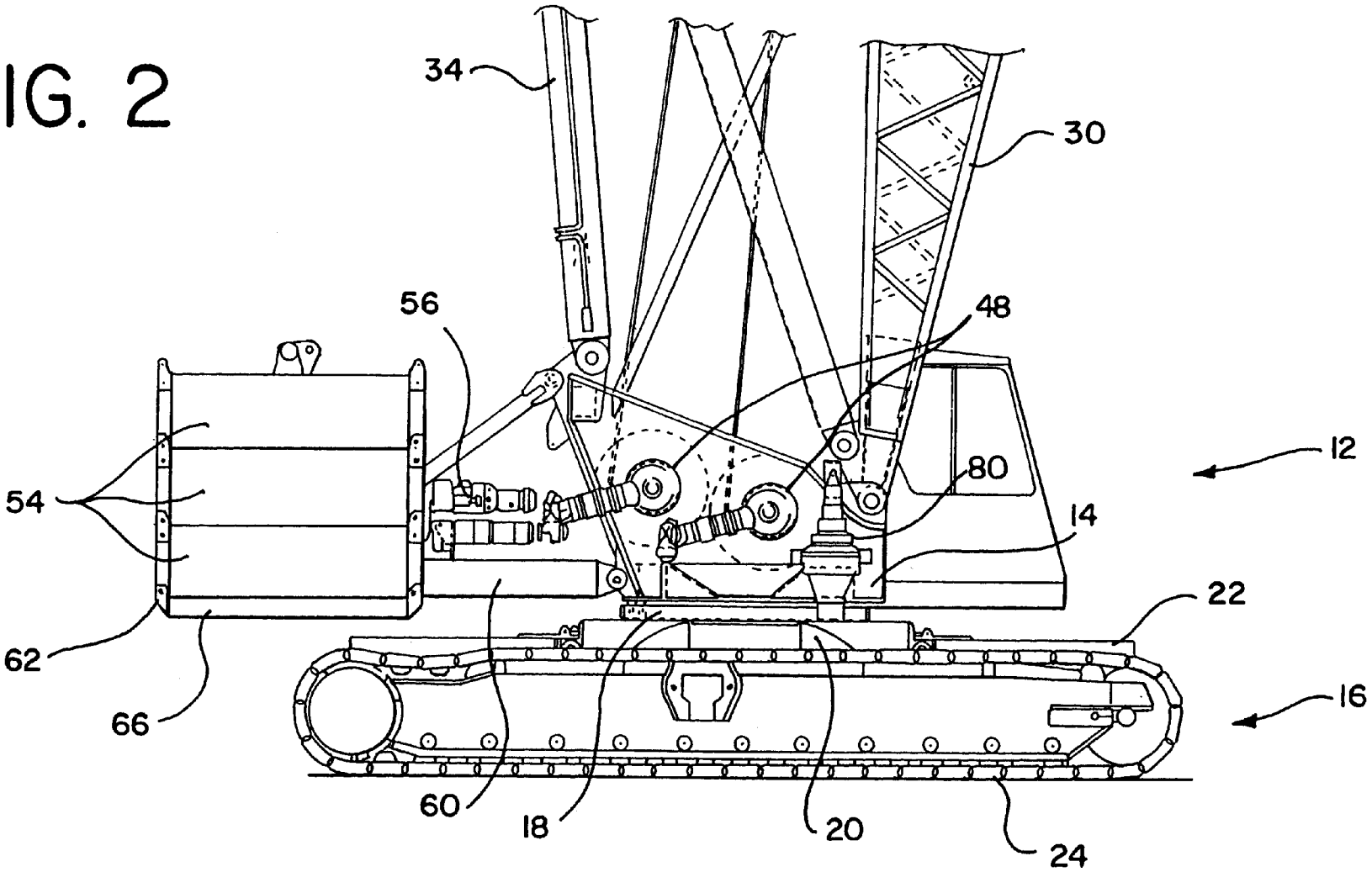
FIG. 2 is a partial right side elevational view of the crawler crane showing some of the internal components of the crane upper works.

While the present invention will find application in all types of vehicles or machines having an upper works rotatably mounted on a lower works, the preferred embodiment of the invention is described in conjunction with the boom hoist cylinder crawler crane 10 of FIGS. 1 and 2. The boom hoist cylinder crawler crane 10 includes an upper works 12 having a rotating bed 14 which is rotatably connected to a lower works 16 by a swing bearing 18. The lower works 16 includes a car body 20, car body counter weights 22, and two independently powered crawlers 24.

The upper works includes a boom 26 pivotally connected to the upper works 12. The boom 26 comprises a boom top 28 and a tapered boom butt 30. The boom 26 may also include one or more boom inserts 32 connected between the boom top 28 and the boom butt 30 to increase the overall length of the boom 26. The angle of the boom 26 is controlled by a pair of hydraulic boom hoist cylinders 34 pivotally connected to the upper works 12. A mast 36 is pivotally connected between the piston rods 38 of the hydraulic boom hoist cylinders 34 and the upper works 12. The boom hoist cylinders 34 are connected to the upper works 12 at a point preferably near the lower end of the boom hoist cylinders 34, but may be connected to the upper works 12 at any point along the bore 40 of the boom hoist cylinders 34. The boom 26 is connected to the piston rods 38 of the hydraulic boom hoist cylinders 34 and the mast 36 by one or more boom pendants 42. The boom pendants 42 may be connected to either the mast 36 or the piston rods 38 of the hydraulic boom hoist cylinders 34, but preferably are connected at a point near the connection between the mast 36 and the piston rods 38 of the hydraulic boom hoist cylinders 34. A boom backstop 44 is provided to prevent the boom 26 from exceeding a safe operating angle.

The position of the boom 26 is controlled by the hydraulic boom hoist cylinders 34. The mast 36 supports the connection between the hydraulic boom hoist cylinders 34 and the boom pendants 42 at a location that is distanced from the axis of the boom 26 to optimize the forces in the boom pendants 42 and the hydraulic boom hoist cylinders 34. This arrangement also permits the hydraulic boom hoist cylinders 34 to impart a force having a component that is perpendicular to the axis of the boom 26. This force is transferred to the end of the boom 26 by the boom pendants 42.

Extending the hydraulic boom hoist cylinders 34 decreases the angle between the front of the boom 26 and the ground. Conversely, retracting the hydraulic boom hoist cylinders 34 increases the angle between the front of the boom 26 and the ground. Under normal operating conditions, the hydraulic boom hoist cylinders 34 and the boom pendants 42 are in tension from the weight of the boom 26 and any load being lifted by the crane 10. Conversely, the mast 36 is in compression under normal operating conditions.

The upper works 12 further includes one or more load hoist lines 46 for lifting loads. Each load hoist line 46 is reeved around a load hoist line drum 48 supported on the rotating bed 14 of the upper works 12. The load hoist line drums 48 are rotated to either pay out or retrieve the load hoist lines 46. The load hoist lines 46 pass through a wire rope guide 50 attached to the upper interior side of the boom butt 30 and are reeved around a plurality of boom top sheaves 52 located at the upper end of the boom top 28. The wire rope guide 50 prevents the load hoist lines 46 from interfering with the lattice structure of the boom 26. A hook block 54 is typically attached to each load hoist line 46.

As best seen in FIG. 2, the upper works 12 further includes a power plant 56 enclosed by a power plant housing 58 and supported on a power plant base 60. The power plant base 60 is connected to the rear of the rotating bed 14. Connected to the power plant base 60 is a upper counter weight assembly 62 comprising a plurality of counter weights 64 supported on a counter weight tray 66. The power plant 56 supplies power for the various mechanical and hydraulic operations of the crane 10, including movement of the crawlers 24, rotation of the rotating bed 14, rotation of the load hoist line drums 48, and operation of the hydraulic boom hoist cylinders 34. The mechanical and hydraulic connections between the power plant 56 and the above-listed components have been deleted for clarity. Operation of the various functions of the crane 10 are controlled from the operator's cab 68.

As discussed above, a swing bearing 18 permits the upper works 12 to rotate relative to the lower works 16. The swing bearing 18 is connected between the car body 20 of the lower works 16 and the rotating bed 14 of the upper works 12.

Figure 3:
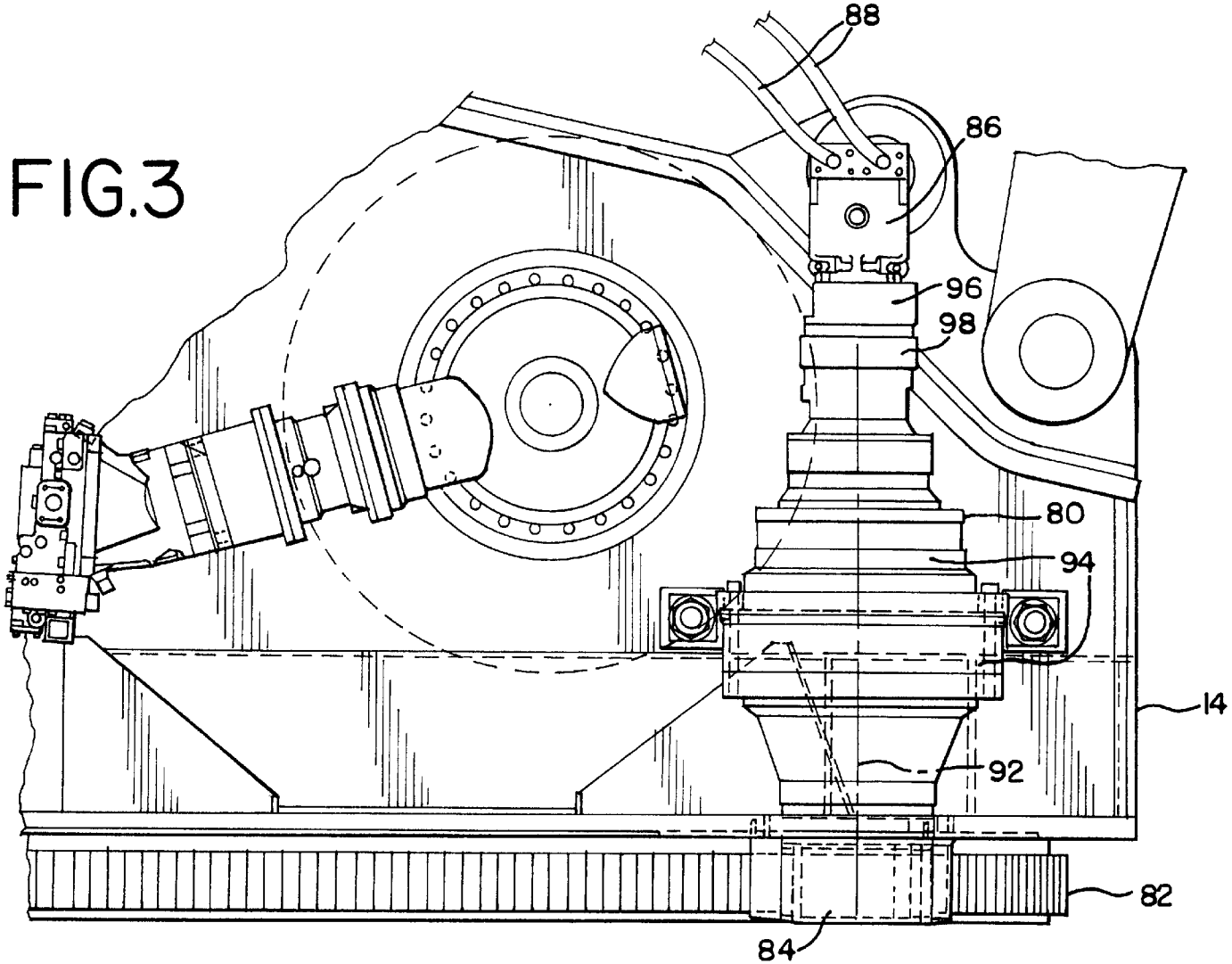
FIG. 3 is a partial elevational view of the crawler crane showing the swing bearing drive assembly.
Figure 4:
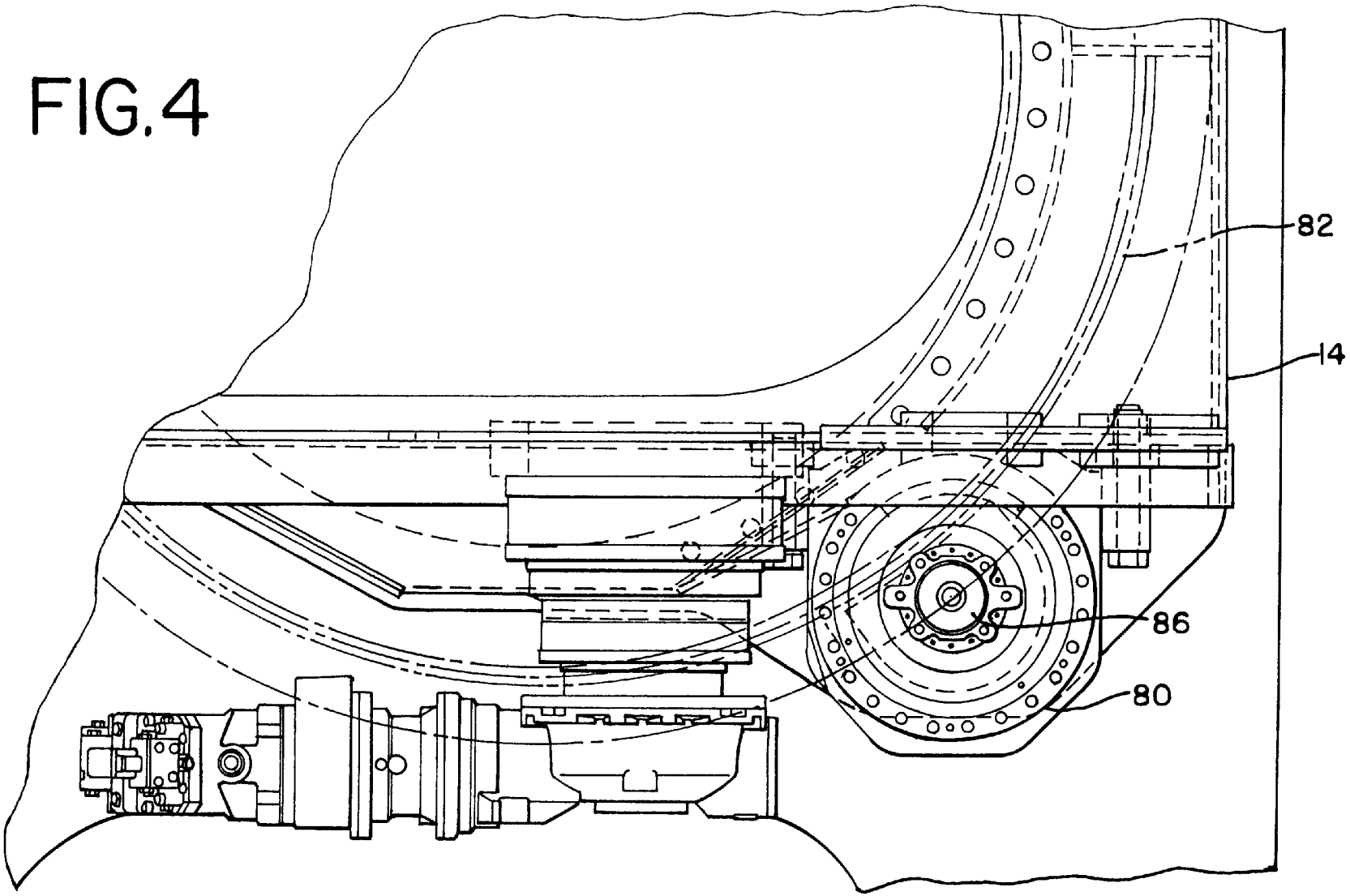
FIG. 4 is a partial plan view of the crawler crane showing the swing bearing drive assembly.

As best seen in FIGS. 2–4, rotation of the upper works 12 is accomplished by a swing bearing drive assembly 80 mounted on the rotating bed 14. The swing bearing drive assembly 80 comprises a pinion gear 84 which engages a slewing ring bull gear 82 mounted on the lower works 16. Rotation of the pinion gear 82 causes the swing bearing drive assembly 80 to advance along the circumference of the slewing ring bull gear 82, thereby causing the upper works 12 to rotate relative to the lower works 16.

As best seen in FIGS. 3 and 4, the swing bearing drive assembly 80 comprises a drive motor 86 for rotating the pinion gear 84. In the preferred embodiment shown, the drive motor 86 is hydraulically driven by the power plant 56. A plurality of hoses 88 connecting the drive motor 86 to the power plant 56 supplies the hydraulic fluid needed to drive the motor 86. The drive motor 86 is connected to a drive shaft 90 which rotates around a central axis 92. The drive shaft 90 is connected to one or more planetary gear sets 94. The planetary gear sets 94 reduce the speed of rotation (rpm) of the pinion gear 84 relative to that of the drive motor 86 through a series of gear reductions. This decrease in rotational speed results in a corresponding increase in the torque or turning force that can be applied by the pinion gear 84 to the slewing ring bull gear 82, thereby reducing the size or capacity of the drive motor 86 required to rotate the upper works 12.

The swing bearing drive assembly 80 also comprises a brake 96 and a swing lock mechanism 98 connected to the drive shaft 90. The brake 96 inhibits, slows or stops the rotation of the pinion gear 84 by applying a frictional force to the drive shaft 90. The brake 96 is of conventional design (e.g., a disk or drum type brake) and is typically hydraulically engaged. The swing lock mechanism 98 prevents the rotation of the upper works 12 by positively locking the drive shaft 90 in a fixed angular orientation. Like the brake 96, the swing lock mechanism 98 is hydraulically engaged. The swing lock mechanism, however, 98 does not require hydraulic pressure to remain engaged, thereby allowing the upper works 12 to be locked against rotation even while the crane 10 is not in use.

In the preferred embodiment shown, both the brake 96 and the swing lock mechanism 98 are located along the drive shaft 90 between the drive motor 86 and any planetary gear sets 94. This allows both of these components to take advantage of the gear reductions provided by the planetary gear sets 94, thereby reducing the amount of torque these components must exert on the drive shaft 90 to inhibit or prevent the rotation of the upper works 12 relative to the lower works 16.

Figure 5:
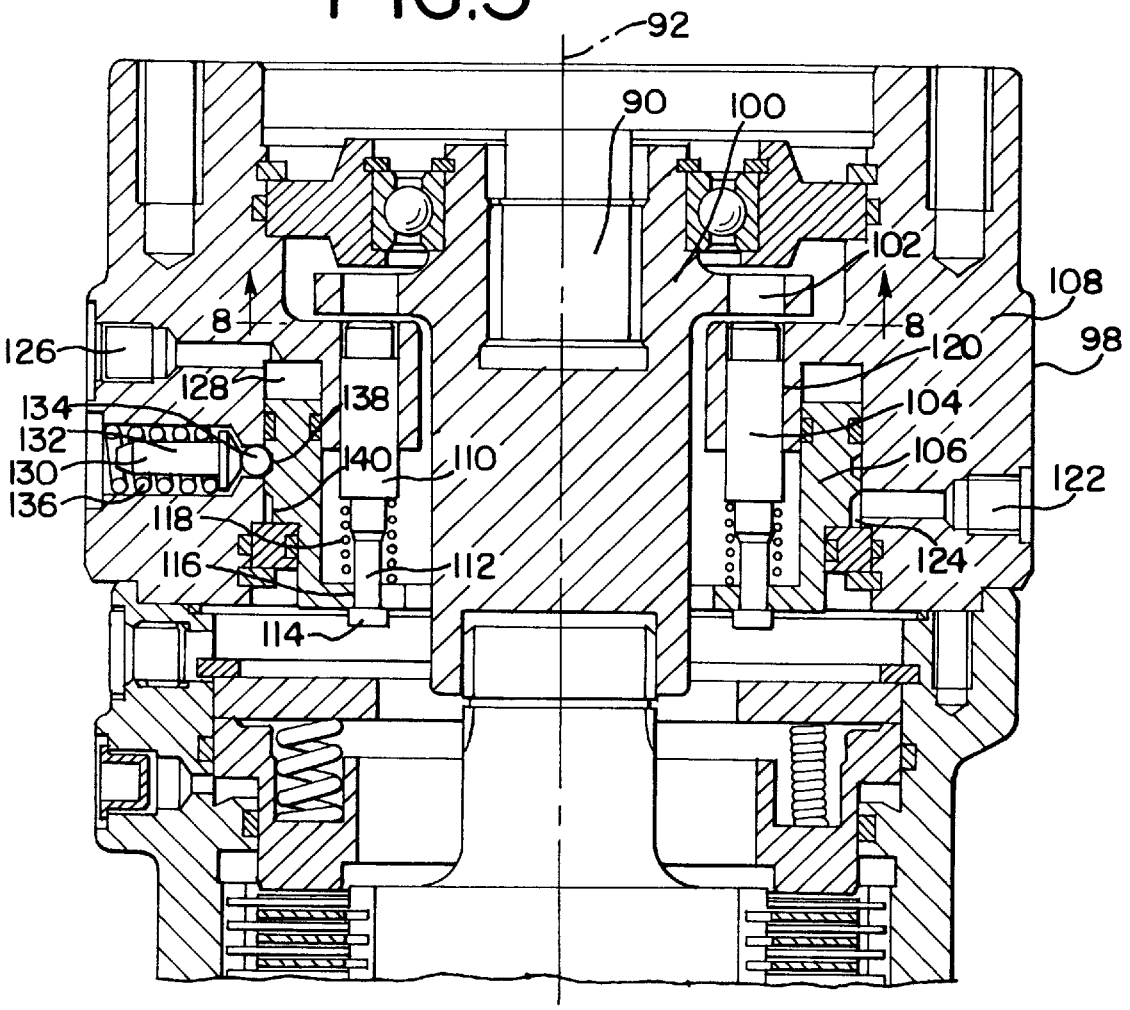
FIG. 5 is a sectional view of the swing lock mechanism in the disengaged position.
Figure 8:
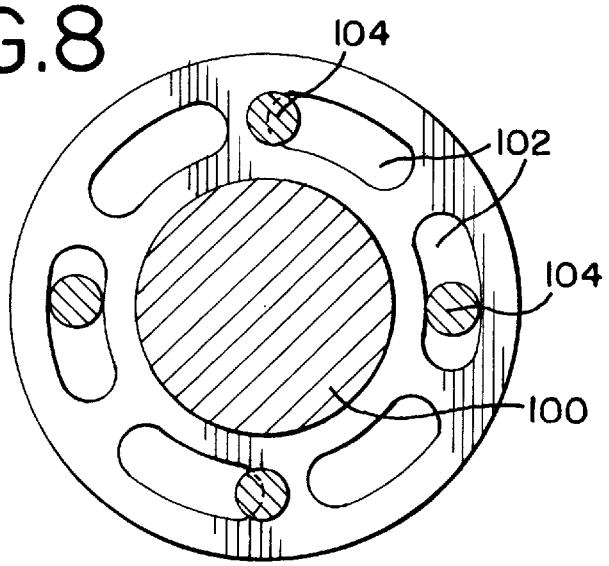
FIG. 8 is a sectional view of the swing lock plate taken along line 8—8 in FIG. 5.
Figure 6:
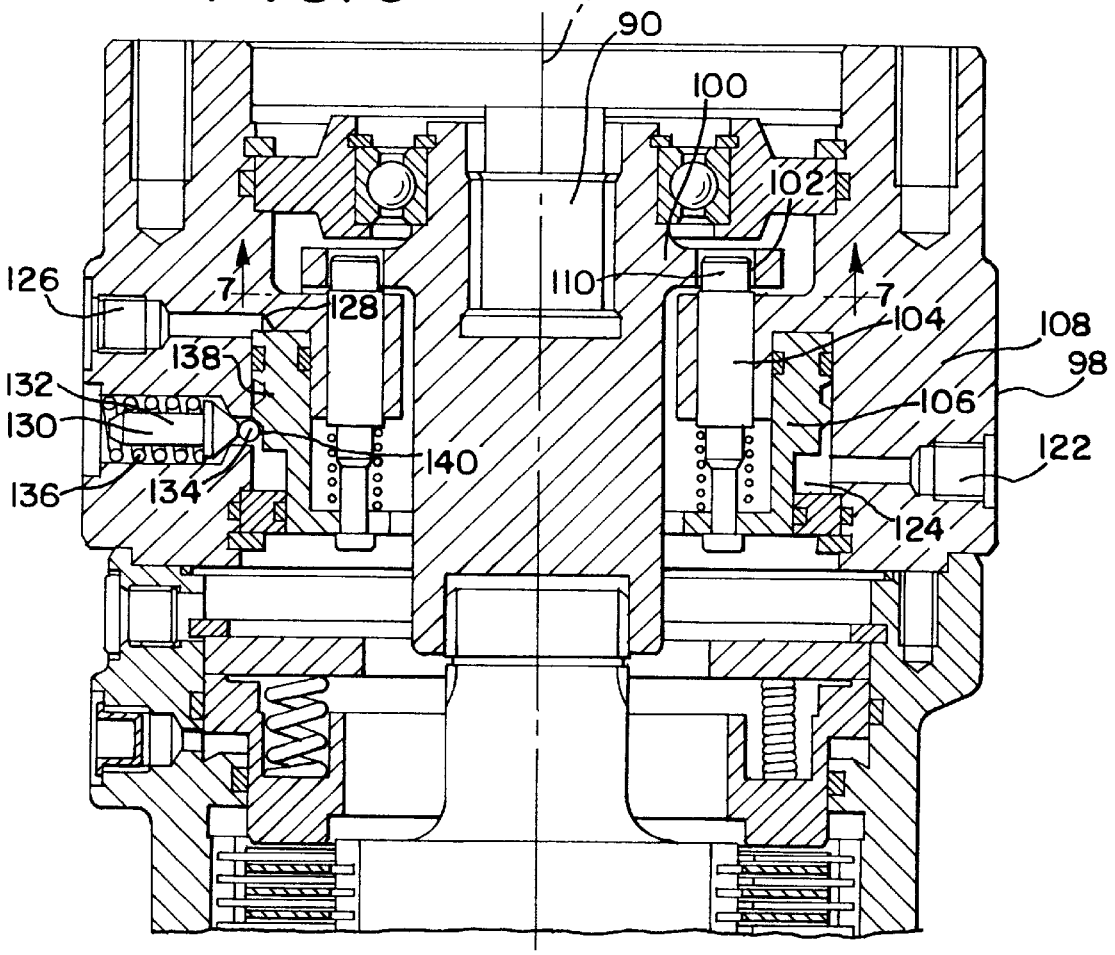
FIG. 6 is a sectional view of the swing lock mechanism in the engaged position.
Figure 7:
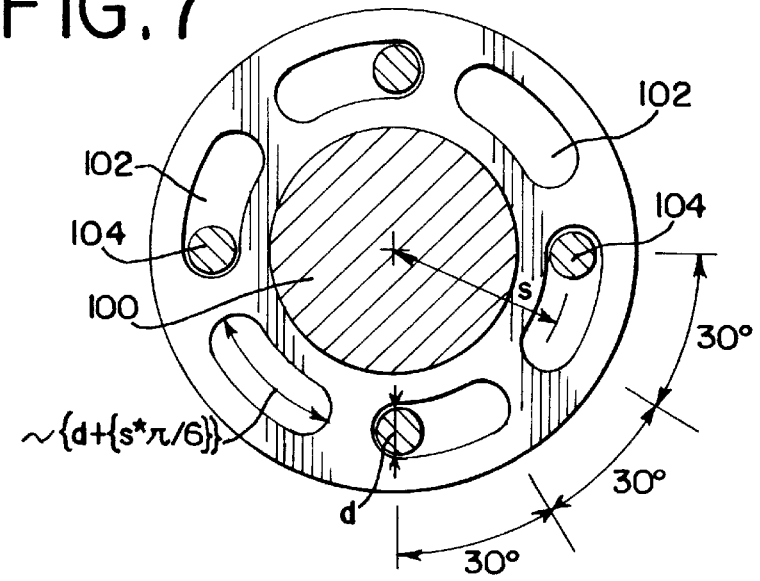
FIG. 7 is a sectional view of the swing lock plate taken along line 7—7 in FIG. 6.

As best seen in FIGS. 5-8, the swing lock mechanism 98 of the preferred embodiment comprises a swing lock plate 100 affixed to the drive shaft 90. The swing lock plate 100 comprises one or more locking holes 102 circumferentially disposed about the central axis 92 of the drive shaft 90. As best seen in FIGS. 7 and 8, the swing lock plate 100 of the preferred embodiment comprises six kidney-shaped locking holes 102 equally spaced around the central axis 92 of the drive shaft 90 (i.e., at 60 degree intervals).

The swing lock mechanism 98 also comprises one or more reciprocating locking pins 104 circumferentially disposed about the central axis 92 of the drive shaft 90. The locking pins 104 are supported by a annular pin support member 106 and a swing lock frame 108. The annular pin support member 106 and the swing lock frame 108 are fixed against rotation relative to the central axis 92. As best seen in FIGS. 7 and 8, the swing lock mechanism 98 of the preferred embodiment comprises four piston-shaped locking pins 104 equally spaced around the central axis 92 of the drive shaft 90 (i.e., at 90 degree intervals).

The locking holes 102 and the locking pins 104 are located a constant distance s from the central axis 92. The locking holes 102 and the locking pins 104 are shaped and arranged in such a manner that at least one of the locking pins 104 will always line-up with one of the locking holes 102 irrespective of the angular orientation of the swing lock plate 100. As best seen in FIGS. 7 and 8, the kidney-shaped locking holes 102 of the preferred embodiment have a width slightly greater than the diameter d of the locking pins 104 and an arc length slightly greater than the diameter of the locking pins 104 plus 30 degrees (i.e., $\{d+\{s*\pi/6\}\}$). This arrangement ensures that at least two of the locking pins 104 will always line-up with two of the kidney-shaped locking holes 102 irrespective of the angular orientation of the swing lock plate 100.

In the preferred embodiment shown, each locking pin 104 comprises a piston 110, a shaft 112, and a flange 114. The shaft 112 of the locking pin 104 projects through a hole 116 in the annular pin support member 106. The locking pin 104 is held in place by the flange 114 and a spring 118. The spring 118 biases the locking pin 104 up towards the swing lock plate 100. The length of the shaft 112 is greater than the length of the hole 116 to permit the locking pin 104 to retract down through the annular pin support member 106. The piston 110 is positioned through a bore 120 in the swing lock frame 108. The swing lock frame 108 guides and provides lateral support for the locking pins 104.

The annular pin support member 106 is supported by the swing lock frame 108 and reciprocates in a direction parallel to the central axis 92 to either engage or disengage the swing lock mechanism 98. In the preferred embodiment shown, the swing lock mechanism 98 is engaged by moving the annular pin support member 106 up towards the swing lock plate 100 and is disengaged by moving the annular pin support member 106 away from the swing lock plate 100. FIG. 5 shows the swing lock mechanism 98 in the disengaged position. FIG. 6 shows the swing lock mechanism in the engaged position.

To engage the swing lock mechanism 98, hydraulic fluid is pumped through the engage port 122 into a lower cavity 124 between the annular pin support member 106 and the swing lock frame 108 to push the annular pin support member 106 up towards the swing lock plate 100. To disengage the swing lock mechanism 98, hydraulic fluid is pumped through the disengage port 126 into a upper cavity 128 between the annular pin support member 106 and the swing lock frame 108 to push the annular pin support member 106 away from the swing lock plate 100.

A resistance mechanism, such as a ball detent 130, is used to hold the annular pin support member 106 in either the engaged or disengaged position (see FIGS. 5 and 6). The ball detent 130 insures that the swing lock mechanism 98 does not unintentionally engage or disengage while the crane 10 is being operated. The ball detent 130 of the preferred embodiment comprises a piston 132 which is connected to, or terminates in, a ball bearing 134. The ball bearing 134 is biased against the annular pin support member 106 by a spring 136 acting on the piston 132. The annular pin support member 106 has two separate indentations (or recessed areas) 138, 140. The ball bearing 134 fits into the upper indentation 138 when the swing lock mechanism 98 is disengaged (see FIG. 5), and fits into the lower indentation 140 when the swing lock mechanism 98 is engaged (see FIG. 6). The shape and configuration of the ball bearing 134 and the indentations 138, 140, in conjunction with the force supplied by the spring 136, provide sufficient resistance to prevent the annular pin support member 106 from unintentionally moving from one position to the other (i.e., to prevent the annular pin support member 106 from creeping up or down). However, the resistance provided by the ball detent 130 is not so great so as to prevent the annular pin support member 106 from being intentionally engaged or disengaged as described above (i.e., by pumping hydraulic fluid through either the engage port 122 or the disengage port 126).

Prior to engaging the swing lock mechanism 98, any rotation of the upper works 12 relative to the lower works 16 is first stopped by using the brake 96. To engage the swing lock mechanism 98, the annular pin support member 106 is moved in a direction parallel to the central axis 92 of the drive shaft 90 up towards the swing lock plate 100. The movement of annular pin support member 106 towards the swing lock plate 100 pushes the locking pins 104 up through the bore 120. Those locking pins 104 that line-up with the locking holes 102 will be pushed into and engage those locking holes 102. Any of the locking pins 104 that do not line-up with the locking holes 102 (see FIG. 8) will be forced to retract down into the annular pin support member 106 (i.e., the locking pin 104 will remain stationary as the annular pin support member 106 moves towards the swing lock plate 100).

As best seen in FIG. 8, the number, shape and arrangement of the locking holes 102 and the locking pins 104 of the preferred embodiment insures that at least two of the four locking pins 104 will always line-up with two of the six kidney-shaped locking holes 102 irrespective of the angular orientation of the swing lock plate 100. Once two of the locking pins 104 are engaged in two of the locking holes 102, the upper works 12 is allowed to rotate until the remaining two locking pins 104 line-up with two of the remaining locking holes 102 (as shown in FIG. 7), whereby the springs 118 will force these locking pins 104 up into the locking holes. No further rotation of the upper works 12 can occur once all four locking pins 104 are engaged.

It should be noted that the planetary gear sets 94 located between the swing lock plate 100 and the pinion gear 84 prevents the upper works 12 from rotating more than 1–2 degrees (depending upon the total gear reduction provided) before the swing lock plate 100 rotates a sufficient angle to allow all of the locking pins 104 to engage the locking holes 102.

To disengage the swing lock mechanism 98, the annular pin support member 106 is moved away from the swing lock plate 100, thereby disengaging the locking pins 104 from the locking holes 102.

Although the preferred embodiment shown utilizes four locking pins and six kidney-shaped locking holes, it should be appreciated that any number of arrangements can be used. For example, two kidney-shaped holes each having an arc length of approximately 90 degrees, or a single kidney-shaped hole having an arc length of approximately 180 degrees, could be used instead of the six kidney-shaped holes of the preferred embodiment shown. In the later arrangement, only two locking pins would be needed to completely secure the upper works against rotation. Finally, the swing lock mechanism could even employ a single round locking pin and a single round locking hole, although this arrangement would perhaps allow a slightly greater amount of rotation in the upper works before the locking pin would engage the locking hole. Other arrangements and configurations could be employed as well.

Thus, while an embodiment of the present invention has been described herein, those with skill in this art will recognize changes, modifications, alterations and the like which still shall come within the spirit of the inventive concept, and such are intended to be included within the scope of the invention as expressed in the following claims.

What is claimed is:

1. A machine having an upper works rotatably mounted on a lower works, a swing bearing, and a swing bearing drive assembly, said swing bearing drive assembly comprising a drive motor connected to a drive shaft, said drive shaft having an axis about which said drive shaft rotates, said swing bearing drive assembly further comprising a swing lock mechanism to prevent the rotation of said upper works relative to said lower works, wherein the swing lock mechanism comprises:

a) a swing lock plate affixed to said drive shaft, said swing lock plate comprising at least one hole disposed about the axis of said drive shaft;

b) a annular pin support disposed about the axis of said drive shaft, said annular pin support affixed against rotation relative to the axis of said drive shaft; and c) a plurality of locking pins supported by said annular pin support, said locking pins disposed about the axis of said drive shaft and arranged in such a manner so as at least one said locking pin is aligned with said at least one hole in said swing lock plate irrespective of the angular orientation of said swing lock plate relative to said annular pin support.

2. A machine according to claim 1 wherein said swing lock plate comprises a plurality of holes circumferentially disposed about the axis of said drive shaft, and further wherein said locking pins are arranged in such a manner so as at least one said locking pin is aligned with one of said holes in said swing lock plate irrespective of the angular orientation of said swing lock plate relative to said annular pin support.

3. The machine according to claim 1 wherein each said hole in said swing lock plate is kidney-shaped.

4. A machine according to claim 1 wherein said locking pins may move independently to permit fewer than all of said locking pins to engage said holes in said swing lock plate.

5. A machine according to claim 1 wherein each of said locking pins comprises a spring which biases said locking pins towards said swing lock plate.

6. A machine according to claim 1 wherein said annular pin support reciprocates along the axis of said drive shaft, and at least one said locking pin engages said hole by moving said annular pin support towards said swing lock plate.

7. A machine according to claim 6 wherein hydraulic fluid is used to effect the reciprocal movement of said annular pin support to either engage or disengage said locking pin in said hole.

8. A machine according to claim 6 wherein a resistance mechanism is used to prevent the reciprocal movement of said annular pin support.

9. A machine according to claim 8 wherein said resistance mechanism is a ball detent.

10. A machine according to claim 1 wherein said swing bearing drive assembly further comprises a planetary gear set, said swing lock mechanism being located between said planetary gear set and said drive motor.

11. A crane having an upper works rotatably mounted on a lower works, a swing bearing, and a swing bearing drive assembly, said swing bearing drive assembly comprising a drive motor, a drive shaft having an axis about which said drive shaft rotates, and a swing lock mechanism to prevent the rotation of said upper works relative to said lower works, wherein said swing lock mechanism comprises:

a) a swing lock plate affixed to said drive shaft, said swing lock plate comprising a plurality of kidney-shaped holes circumferentially disposed about the axis of said drive shaft;

b) a annular pin support disposed about the axis of said drive shaft, said annular pin support affixed against rotation relative to the axis of said drive shaft; and c) a plurality of reciprocating locking pins supported by said annular pin support, said locking pins circumferentially disposed at equal intervals about the axis of said drive shaft and arranged in such a manner so as at least one of said locking pins is aligned with one of the kidney-shaped holes irrespective of the angular orientation of said swing lock plate relative to said annular pin support.

12. A crane according to claim 11 wherein at least one of said locking pins is engaged in one of said kidney-shaped holes.

13. A crane according to claim 12 wherein said drive shaft is prevented from rotating about said axis when each of said locking pins are engaged in said kidney-shaped holes.

14. A crane according to claim 11 wherein said swing lock plate comprises six kidney-shaped holes and further wherein said plurality of locking pins comprise four locking pins arranged in such a manner so as at least two of said locking pins are aligned with two of the kidney-shaped holes irrespective of the angular orientation of said swing lock plate relative to said annular pin support.

15. A crane according to claim 14 wherein said locking pins are circumferentially disposed a constant distance s from the axis of said drive shaft at 90 degree intervals about said axis, each said locking pin comprising a shaft of diameter d, further wherein said kidney-shaped holes are circumferentially disposed at 60 degree intervals about the axis of said drive shaft, each said kidney-shaped hole having an approximate width of d and an approximate arc length $\{d+\{s*\pi/6\}\}$.

16. A crane according to claim 14 wherein the four locking pins are arranged in such a manner that each locking pin is aligned with one of said kidney-shaped holes.

17. A crane according to claim 16 wherein said drive shaft is prevented from rotating about said axis when each of said four locking pins are engaged in said kidney-shaped holes.

18. A crane according to claim 11 wherein said annular pin support and said plurality of locking pins are supported by a swing lock frame.

19. A crane according to claim 11 wherein said annular pin support is reciprocated along the axis of said drive shaft.

20. A crane according to claim 19 wherein at least one of said plurality of locking pins is engaged in one of said kidney-shaped holes when said annular pin support is moved towards said swing lock plate.

21. A crane according to claim 19 wherein hydraulic fluid is used to effect the reciprocal movement of said annular pin support to either engage or disengage at least one of said locking pins in one of said kidney-shaped holes.

22. A crane according to claim 19 wherein a resistance mechanism is used to prevent the reciprocal movement of said annular pin support.

23. A crane according to claim 22 wherein said resistance mechanism is a ball detent.

24. A crane according to claim 11 wherein said reciprocal movement of said plurality of locking pins is independent relative to each other to permit fewer than all of said locking pins to engage said kidney-shaped holes.

25. A crane according to claim 11 wherein each of said plurality of locking pins comprise a spring which biases said locking pin towards said swing lock plate.

26. A crane according to claim 11 wherein said swing bearing drive assembly further comprises a planetary gear set, said swing lock mechanism being located between said planetary gear set and said drive motor.

27. A crane having an upper works rotatably mounted on a lower works, a swing bearing, and a swing bearing drive assembly, said swing bearing drive assembly comprising a drive motor, a drive shaft having an axis about which said drive shaft rotates, and a swing lock mechanism to prevent the rotation of said upper works relative to said lower works, wherein said swing lock mechanism comprises:

a) a swing lock plate affixed to said drive shaft, said swing lock plate comprising six kidney-shaped holes circumferentially disposed at equal intervals about the axis of said drive shaft;

b) a reciprocating annular pin support disposed about the axis of said drive shaft, said annular member affixed against rotation relative to the axis of said drive shaft;

c) four reciprocating locking pins supported by said annular pin support, said locking pins circumferentially disposed at equal intervals about the axis of said drive shaft and arranged in such a manner so as at least two of the locking pins are aligned with two of the kidney-shaped holes irrespective of the angular orientation of said swing lock plate relative to said annular pin support; and d) a swing lock frame which provides lateral support to said annular pin support and to said locking pins.

28. The crane according to claim 27 wherein said drive shaft is prevented from rotating when all of said locking pins are engaged in said kidney-shaped holes.

29. The crane according to claim 27 wherein said drive shaft is prevented from rotating more than 30 degrees when two of said locking pins are engaged in said kidney-shaped holes.

30. The crane according to claim 29 wherein said drive shaft is rotated to engage the remaining two locking pins in said kidney-shaped holes.

31. The crane according to claim 27 wherein said annular pin support is moved towards said swing lock plate to engage said locking pins in said kidney-shaped holes.

32. The crane according to claim 31 wherein hydraulic fluid is used to move said annular pin support towards said swing lock plate.

33. The crane according to claim 27 wherein each of said locking pins comprises a spring which biases said locking pins towards said locking plate.

34. The crane according to claim 27 wherein each locking pin moves independently to permit engagement by less than all of said locking pins in said kidney-shaped holes.

35. A machine having an upper works rotatably mounted on a lower works, a swing bearing, and a swing bearing drive assembly, said swing bearing drive assembly comprising a drive motor connected to a drive shaft, said drive shaft having an axis about which said drive shaft rotates, said swing bearing drive assembly further comprising a swing lock mechanism to prevent the rotation of said upper works relative to said lower works, wherein the swing lock mechanism comprises:

a) a swing lock plate affixed to said drive shaft, said swing lock plate comprising at least one hole disposed about the axis of said drive shaft;

b) a annular pin support disposed about the axis of said drive shaft, said annular pin support affixed against rotation relative to the axis of said drive shaft, wherein said annular pin support reciprocates along the axis of said drive shaft, said reciprocal movement being effected by hydraulic fluid; and c) a plurality of locking pins supported by said annular pin support, said locking pins disposed about the axis of said drive shaft and arranged in such a manner so as at least one said locking pin is aligned with said at least one hole in said swing lock plate irrespective of the angular orientation of said swing lock plate relative to said annular pin support, wherein said at least one locking pin engages said hole by moving said annular pin support towards said swing lock plate.

36. A machine according to claim 35 wherein a resistance mechanism is used to prevent the reciprocal movement of said annular pin support.

37. A crane having an upper works rotatably mounted on a lower works, a swing bearing, and a swing bearing drive assembly, said swing bearing drive assembly comprising a drive motor, a drive shaft having an axis about which said drive shaft rotates, and a swing lock mechanism to prevent the rotation of said upper works relative to said lower works, wherein said swing lock mechanism comprises:

a) a swing lock plate affixed to said drive shaft, said swing lock plate comprising a plurality of kidney-shaped holes circumferentially disposed about the axis of said drive shaft;

b) a annular pin support disposed about the axis of said drive shaft, said annular pin support affixed against rotation relative to the axis of said drive shaft, wherein said annular pin support reciprocates along the axis of said drive shaft; and c) a plurality of reciprocating locking pins supported by said annular pin support, said locking pins circumferentially disposed at equal intervals about the axis of said drive shaft and arranged in such a manner so as at least one of said locking pins is aligned with one of the kidney-shaped holes irrespective of the angular orientation of said swing lock plate relative to said annular pin support, wherein said at least one locking pin engages one of said kidney-shaped hole by moving said annular pin support towards said swing lock plate.

38. A crane according to claim 37 wherein hydraulic fluid is used to effect the reciprocal movement of said annular pin support to either engage or disengage at least one of said locking pins in one of said kidney-shaped holes.

39. A crane according to claim 37 wherein said swing bearing drive assembly further comprises a planetary gear set, said swing lock mechanism being located between said planetary gear set and said drive motor.

* * * * *

UNITED STATES PATENT AND TRADEMARK OFFICE

CERTIFICATE OF CORRECTION

PATENT NO. : 6,010,018

DATED : January 4, 2000

INVENTOR(S) : David J. Pech

It is certified that error appears in the above-identified patent and that said Letters Patent is hereby corrected as shown below:

Claim 37, Col. 10, line 31, change "hole" to -- holes --.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*